US009482245B2

(12) United States Patent
Palmer et al.

(10) Patent No.: US 9,482,245 B2
(45) Date of Patent: Nov. 1, 2016

(54) CYLINDER LENGTH SENSOR MOUNTING/RETAINING ASSEMBLY

(75) Inventors: Christopher L. Palmer, McConnellsburg, PA (US); Lex A. Mellott, McConnellsburg, PA (US)

(73) Assignee: JLG INDUSTRIES, INC., Hagerstown, MD (US)

( * ) Notice: Subject to any disclaimer, the term of this patent is extended or adjusted under 35 U.S.C. 154(b) by 619 days.

(21) Appl. No.: 13/876,112

(22) PCT Filed: Oct. 25, 2011

(86) PCT No.: PCT/US2011/057624

§ 371 (c)(1), (2), (4) Date: Mar. 26, 2013

(87) PCT Pub. No.: WO2012/058195

PCT Pub. Date: May 3, 2012

(65) Prior Publication Data

US 2013/0174727 A1 Jul. 11, 2013

Related U.S. Application Data

(60) Provisional application No. 61/406,698, filed on Oct. 26, 2010.

(51) Int. Cl.
*F15B 15/20* (2006.01)
*F15B 15/28* (2006.01)

(52) U.S. Cl.
CPC ..... *F15B 15/20* (2013.01); *F15B 15/2892* (2013.01); *Y10T 29/4927* (2015.01)

(58) Field of Classification Search
CPC ..... F15B 15/2815; F15B 15/2892; F15B 15/2823
See application file for complete search history.

(56) References Cited

U.S. PATENT DOCUMENTS 3,403,365 A * 9/1968 Richards ..... F15B 15/2823 336/30
3,638,983 A 2/1972 Flournoy et al.
4,316,145 A 2/1982 Tann
4,523,514 A * 6/1985 Burk ..... F15B 15/2853 338/176
5,058,622 A 10/1991 Chitty, Jr. et al.

(Continued)

FOREIGN PATENT DOCUMENTS

CN 1867777 11/2006
DE EP 1070856 A1 * 1/2001 ..... F15B 15/2823

(Continued)

OTHER PUBLICATIONS

Chinese Office Action dated Feb. 15, 2015 issued in Chinese Patent Application No. 201180052031.6 and English Translation, 18 pp.

(Continued)

*Primary Examiner* — John K Fristoe, Jr.
*Assistant Examiner* — Matthew Wiblin
(74) *Attorney, Agent, or Firm* — Nixon & Vanderhye P.C.

(57) ABSTRACT

A cylinder length sensor mounting and retaining assembly for a hydraulic cylinder includes a casing attachable to a blind end of the cylinder, a sensor retention cap affixable to the casing adjacent the blind end of the cylinder, and a locking pin extendable through the casing and positioned adjacent the sensor retention cap. The assembly facilitates sensor removal without requiring disassembly of the cylinder.

15 Claims, 6 Drawing Sheets

(56) References Cited

U.S. PATENT DOCUMENTS

| | | | |
|---|---|---|---|
| 5,150,049 | A | 9/1992 | Schuetz |
| 5,182,980 | A | 2/1993 | Greer |
| 5,450,009 | A | 9/1995 | Murakami |
| 5,477,771 | A | 12/1995 | Black |
| 5,909,116 | A | 6/1999 | Jin et al. |
| 5,952,823 | A | 9/1999 | Nyce et al. |
| 6,450,048 | B1 | 9/2002 | Samuelson et al. |
| 6,509,733 | B2 | 1/2003 | Bluaugh et al. |
| 6,725,761 | B1 | 4/2004 | McNaughton |
| 6,843,083 | B2 | 1/2005 | Smith et al. |
| 7,023,199 | B2 | 4/2006 | Blubaugh et al. |
| 7,059,238 | B2 | 6/2006 | Albright et al. |
| 7,757,547 | B2 | 7/2010 | Kageyama et al. |
| 7,855,551 | B2 | 12/2010 | Steinich |
| 2005/0007099 | A1 | 1/2005 | Hamasagar et al. |
| 2005/0231197 | A1 | 10/2005 | Reininger et al. |
| 2005/0263001 | A1* | 12/2005 | Alrefai ..... F15B 15/2815 92/164 |
| 2009/0272157 | A1 | 11/2009 | Alaniz |
| 2010/0050863 | A1 | 3/2010 | Wenker et al. |
| 2010/0095840 | A1 | 4/2010 | Osborn et al. |
| 2010/0223982 | A1 | 9/2010 | Siraky |

FOREIGN PATENT DOCUMENTS

| | | |
|---|---|---|
| JP | 11-241704 | 9/1999 |
| JP | 2000-179509 | 6/2000 |
| JP | 2005-337506 | 12/2005 |

OTHER PUBLICATIONS

Japanese Office Action mailed Feb. 25, 2014 issued in Japanese Patent Application No. 2013-534072 and English Translation, 9 pp.

* cited by examiner

CYLINDER LENGTH SENSOR MOUNTING/RETAINING ASSEMBLY

This application is the U.S. national phase of International Application No. PCT/US2011/057624 filed 25 Oct. 2011 which designated the U.S. and claims priority to U.S. Provisional Application No. 61/406,698 filed 26 Oct. 2010, the entire contents of each of which are hereby incorporated by reference.

BACKGROUND OF THE INVENTION

The invention relates to a sensor mounting/retaining assembly and, more particularly, to a cylinder length sensor mounting/retaining assembly that facilitates access to the sensor without requiring disassembly of the cylinder.

Magnetostrictive length sensors can be incorporated into hydraulic cylinders. The sensors accurately measure a linear position of the cylinder rod. In incorporating such sensors into hydraulic cylinders, in the event a sensor needs to be repaired or replaced, existing designs require disassembly of the cylinder to access the sensor. FIG. 1 is a cross-section through an exemplary prior art installation from the head end of the cylinder barrel, and FIG. 2 is a cross-section of an exemplary prior art installation through the blind end of the cylinder barrel. In the FIG. 1 installation, access to the sensor requires complete disassembly of the cylinder. Similarly, in the FIG. 2 installation, at least the rear structure of the cylinder must be disassembled to access the sensor. Moreover, the bolts shown in FIG. 2 are subjected to cylinder forces, which far exceed the pressures acting on the sensor.

Additionally, existing sensors include an electrical connector of a two-piece construction that can be disassembled for sensor removal without soldering or removal of separate pins/conductors. The existing electrical connector, however, requires the use of four small fasteners. Corresponding threads are typically machined into the barrel weldment. This is a disadvantage since damage to the threads could possibly ruin the entire barrel weldment or at a minimum require excessive repair costs. Once the small fasteners are removed, the existing connector can be unsnapped into halves, allowing the sensor to be removed.

SUMMARY OF THE INVENTION

It would be desirable to provide a cylinder length sensor mounting/retaining assembly that facilitates access to the sensor without requiring disassembly of the cylinder. It would also be desirable to provide a design that does not require disassembly of the connector when removing the sensor from the cylinder. Such a design increases the reliability of the sensor since it does not require an electrical junction at the cylinder.

In an exemplary embodiment, a cylinder length sensor mounting and retaining assembly for a hydraulic cylinder includes a casing attachable to a blind end of the cylinder and a sensor retention cap affixable adjacent the blind end of the cylinder to close a sensor receiving channel. A first channel extends through the casing and is oriented substantially in alignment with the sensor receiving channel, and a second channel extends through the casing and intersects the first channel. A locking pin is extendable through the second channel, where the second channel is positioned relative to the sensor retention cap such that with the locking pin extending through the second channel, the locking pin is disposed adjacent the sensor retention cap.

The second channel may be substantially perpendicular to the first channel. In one arrangement, the sensor retention cap is secured to the casing with a plurality of mounting bolts. The second channel may be defined by separate and aligned pin receiving sections, where the first channel bisects the pin receiving sections. In this context, with the locking pin extending through the second channel, the locking pin may be positioned to block the first channel. In this context, the locking pin may be spaced from sensor retention cap by an amount that prevents the sensor retention cap from moving enough to leak. The sensor retention cap may include a sensor retention cap cavity that is sized to receive the cylinder length sensor. In this context, the sensor retention cap cavity may be shaped such that it is positively draining and allows moisture to exit freely from the cavity. The assembly may include an overmolded cordset through which a control module connector extends without requiring an electrical junction at the cylinder. The cordset is preferably long enough to attach to a cylinder control module.

In another exemplary embodiment, a cylinder length sensor mounting and retaining assembly for a hydraulic cylinder includes a casing attachable to a blind end of the cylinder, a sensor retention cap affixable to the casing adjacent the blind end of the cylinder, and a locking pin extendable through the casing and positioned adjacent the sensor retention cap.

In yet another exemplary embodiment, a method of mounting and retaining a cylinder length sensor in a hydraulic cylinder includes the steps of securing a casing to a blind end of the cylinder; affixing a sensor retention cap to the casing adjacent the blind end of the cylinder; and positioning a locking pin through a channel in the casing such that the locking pin is disposed adjacent the sensor retention cap.

The positioning step may be practiced by defining a first channel that extends through the casing and is oriented substantially in alignment with a sensor receiving channel, by defining a second channel extending through the casing and intersecting the first channel, and by extending the locking pin through the second channel positioned relative to the sensor retention cap such that with the locking pin extending through the second channel, the locking pin is disposed adjacent the sensor retention cap.

BRIEF DESCRIPTION OF THE DRAWINGS

These and other aspects and advantages will be described in detail with reference to the accompanying drawings, in which.

DETAILED DESCRIPTION OF THE DRAWINGS

With reference to FIGS. 3-7, a hydraulic cylinder 10 is shown including a linear sensor 12 that is incorporated into the cylinder 10. A cylinder length sensor mounting and retaining assembly 14 serves to secure and retain the sensor 12 in the cylinder 10.

Figure 3:
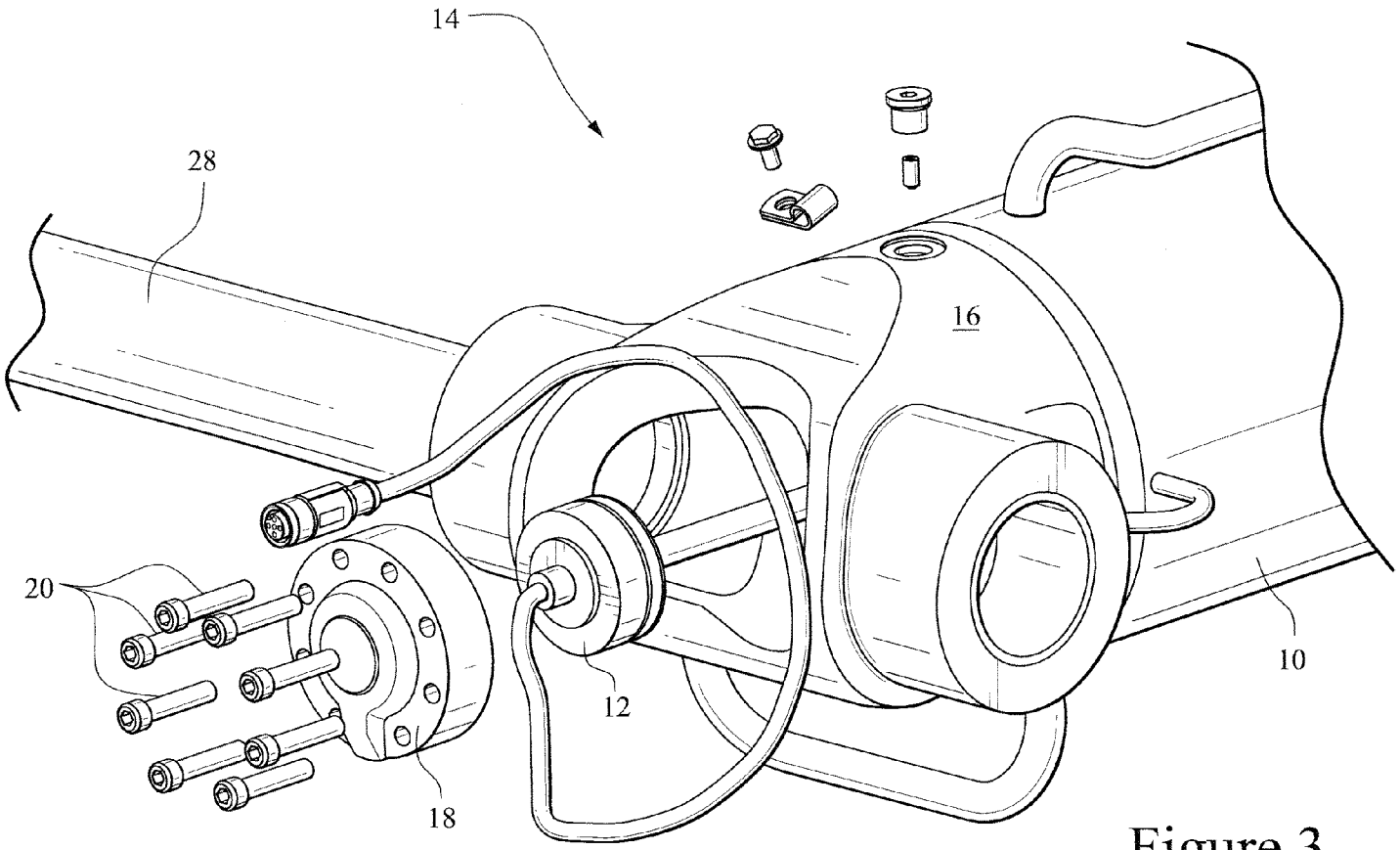
FIGS. 3-6 show the cylinder length sensor mounting and retaining assembly of the described embodiments.
Figure 4:
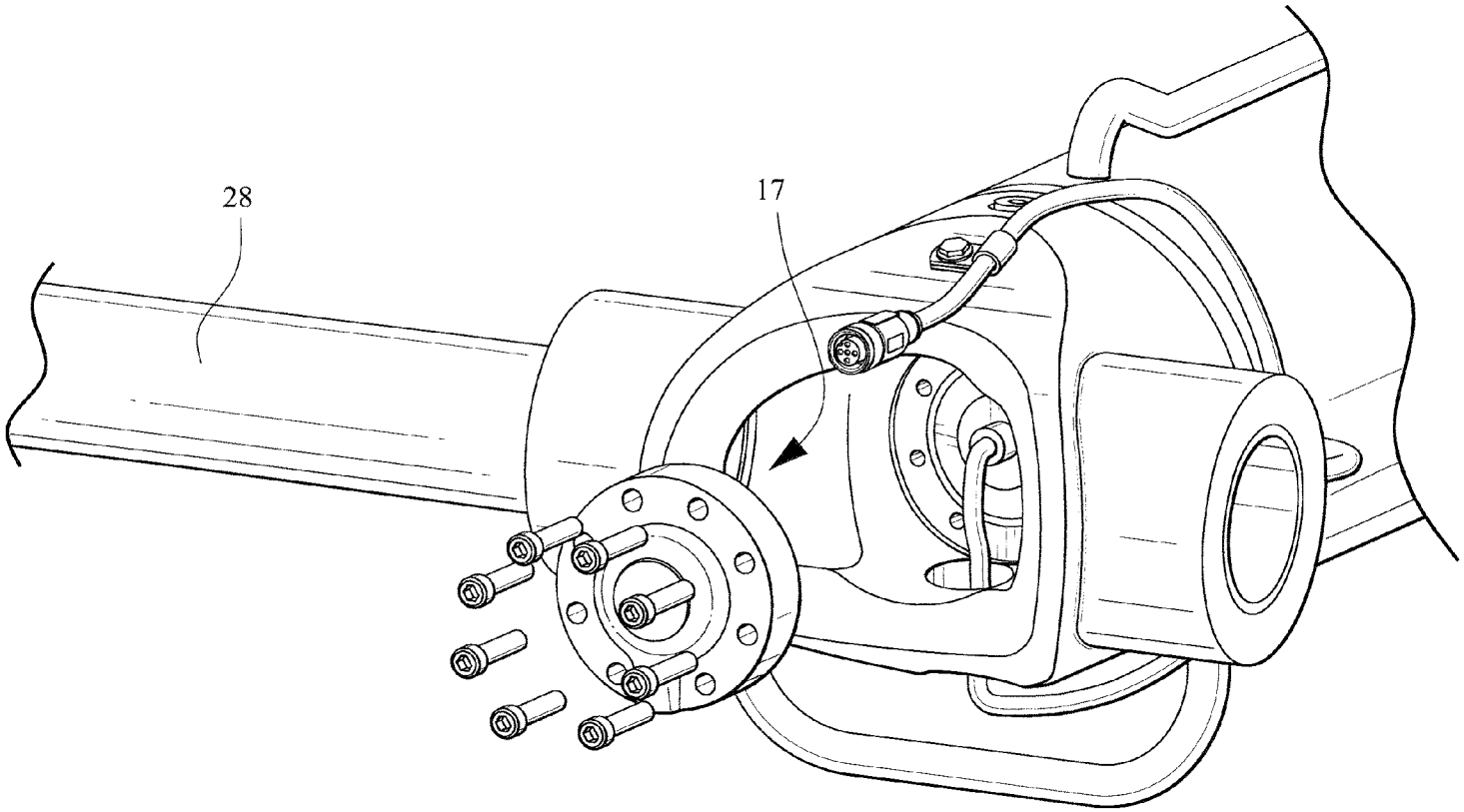

The assembly 14 includes a casing 16 attachable to a blind end of the cylinder 10 (as shown in FIG. 3). A sensor retention cap 18 is affixable to the casing 16 via suitable fasteners 20 adjacent the blind end of the cylinder 10 to close a sensor receiving channel. Preferably, the retention cap 18 is provided with a sensor retention cap cavity 17 that is shaped such that it is positively draining and allows moisture to exit freely from the cavity through a hole in the casing 16 (see FIG. 7). That is, a mounting face of the sensor retention cap cavity 17 is recessed in a counter bore so that exterior moisture (e.g., water from blowing rain, power washing, etc.) has a tortured path to reach the mounting interface. Additionally, the sensor cap cavity 17 is provided with a large drain area to allow any ingressed water or condensation to drain. The sensor retention cap cavity 17 also prevents condensation build-up in the cavity, which could possibly lead to moisture ingress at the back end of the sensor.

Figure 5:
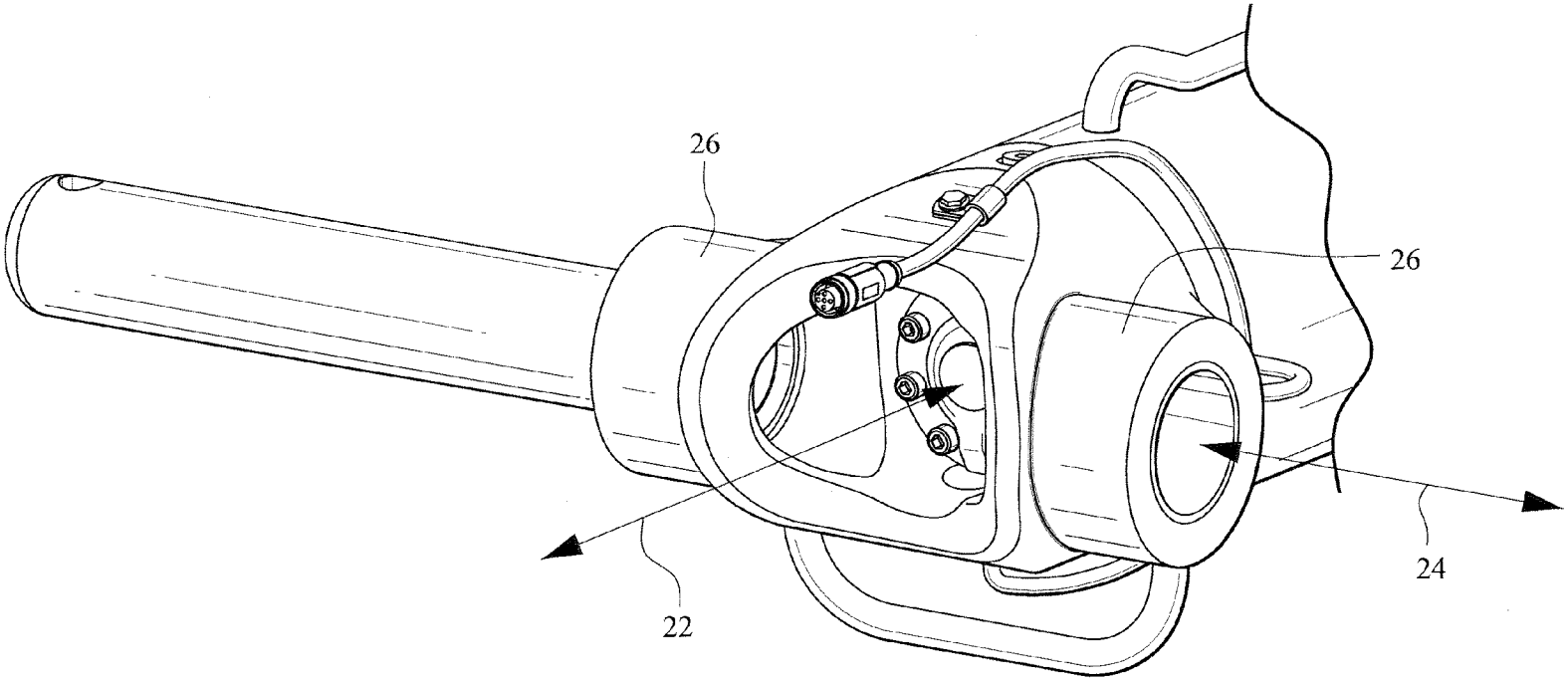
Figure 6:
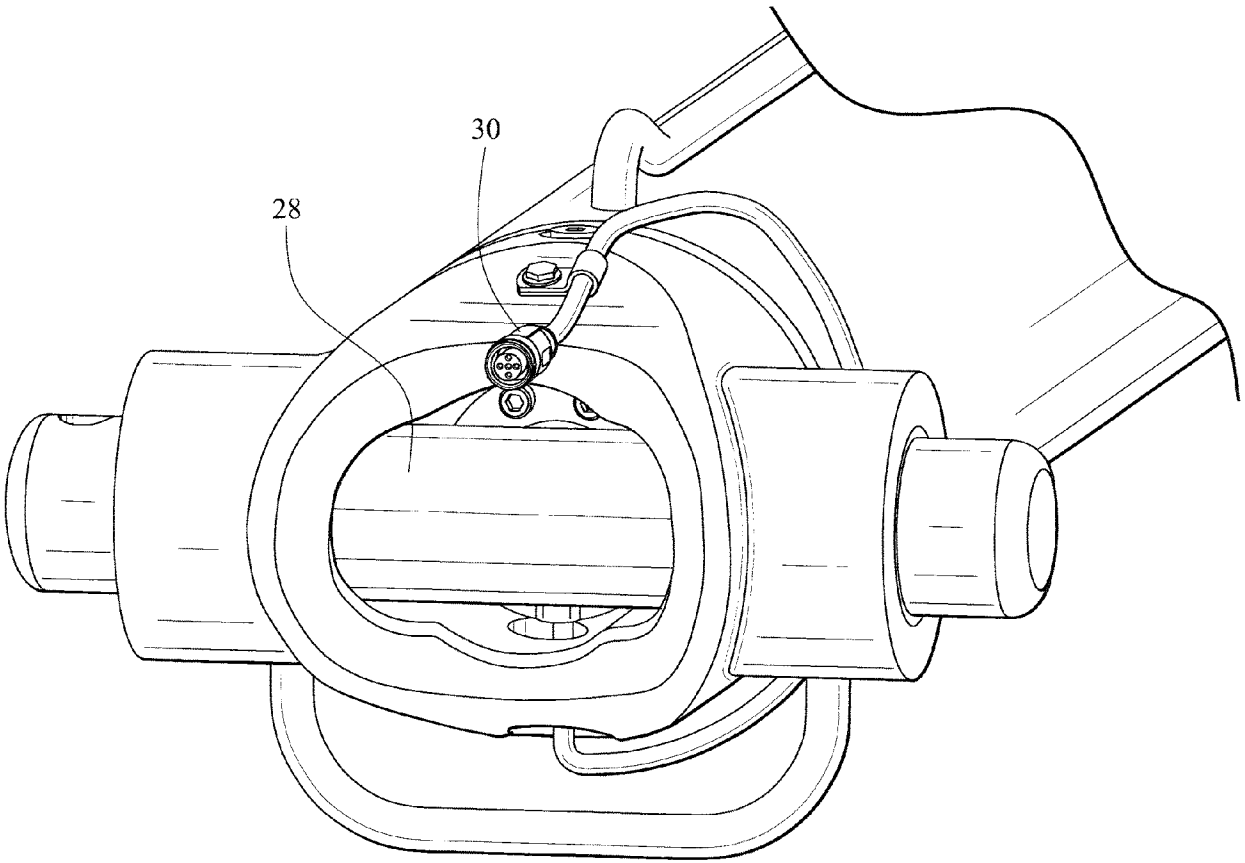
Figure 7:
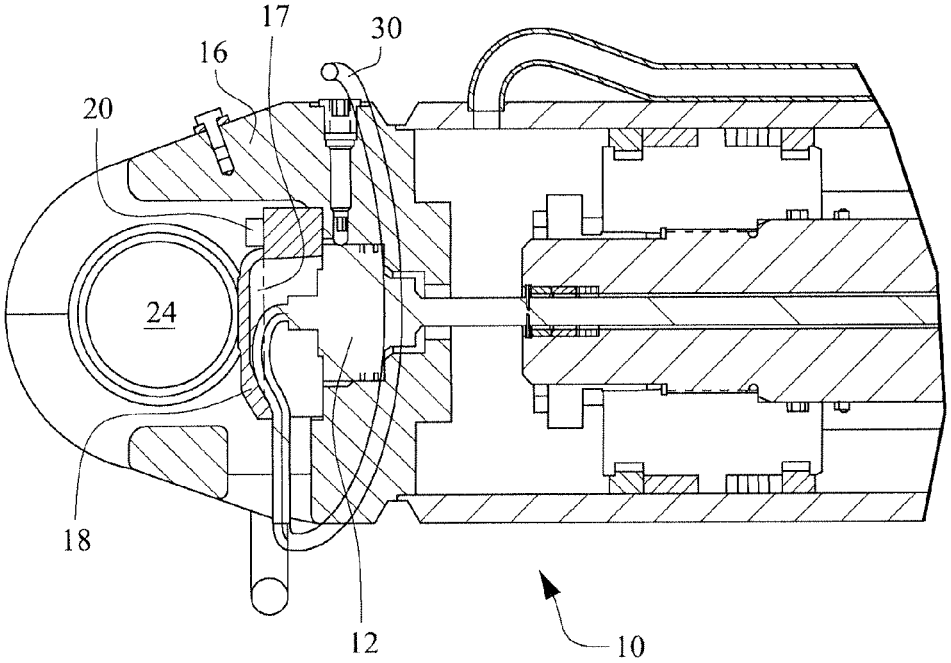
FIG. 7 is a section view showing the cylinder length sensor mounting and retaining assembly.

As shown in FIG. 5, a first channel or bore 22 extends through the casing 16 and is oriented substantially in alignment with the sensor receiving channel. A second channel or bore 24 extends through the casing 16 and intersects the first channel 22. Preferably, the second channel 24 is substantially perpendicular to the first channel 22. The second channel 24 may be defined by separate and aligned pin receiving sections 26. As shown in FIG. 5, the first channel 22 bisects the pin receiving sections 26.

A locking pin 28 is extendible through the second channel 24. The locking pin 28 is the cylinder pivot pin that serves to secure the cylinder to adjoining structure. As shown, the second channel 24 is positioned relative to the sensor retention cap 18 such that with the locking pin 28 extending through the second channel 24, the locking pin 28 is disposed adjacent the sensor retaining cap 18. In this context, with the locking pin 28 extending through the second channel 24, the locking pin 28 is positioned to block the first channel 22.

Figure 1:
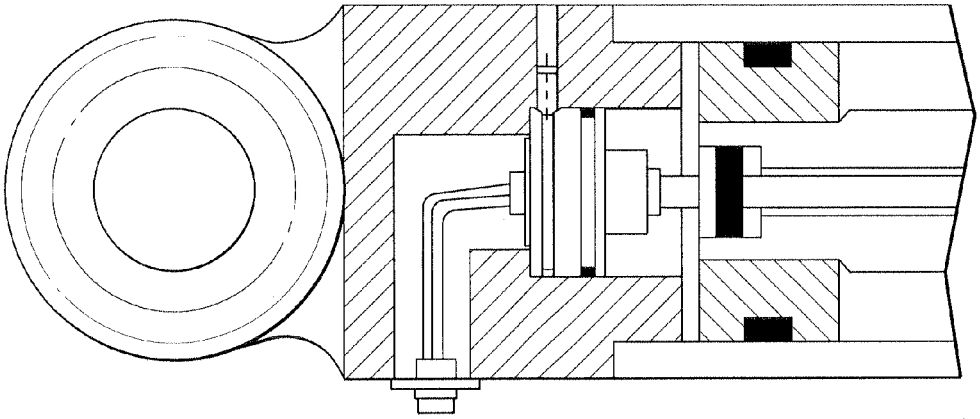
Figure 1 (Prior Art)
FIG. 1 is a sectional view through an existing cylinder arranged for sensor assembly form the head end of the cylinder barrel.
Figure 2:
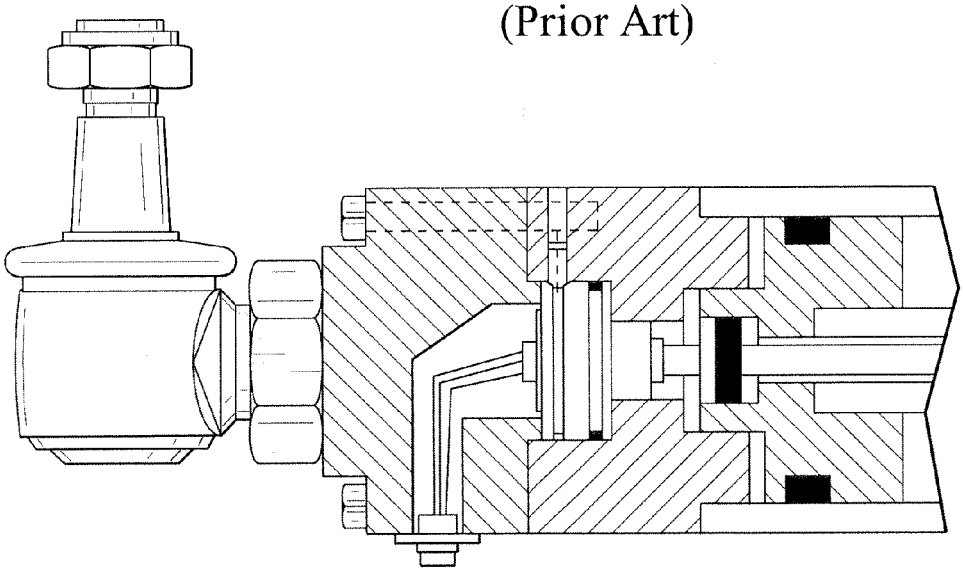
Figure 2 (Prior Art)
FIG. 2 is a sectional view of an existing cylinder arranged for sensor assembly through the blind end of the cylinder barrel.

The sensor retention cap 18 secured to the sensor retention cap cavity 17 is mechanically separate from the main structure of the cylinder 10. As such, the mounting bolts 20 need only accommodate the pressures/forces acting on the sensor (as opposed to the entire cylinder as in the prior art design shown in FIG. 2). If the mounting bolts 20 were to loosen or fail, the retention cap 18 is restricted to small linear movement until it contacts the locking pin 28. The position of the locking pin 28 relative to the retention cap 18 is small enough such that it does not allow the sensor seal to disengage. As a consequence, sudden/rapid leak-down of the cylinder is prevented.

In order to access the sensor 12, after removing the locking pin 28 only the retention cap 18 needs to be removed, and disassembly of the cylinder is not required.

In order to avoid requiring disassembly of the connector when removing the sensor 12 from the cylinder 10, the design utilizes an over-molded cordset 30. The cordset 30 includes a cable and plug connector integrated into a single piece with the insulation over-molded to provide strain relief and moisture protection. This structure increases the reliability of the sensor since it does not require an electrical junction at the cylinder 10. The cordset 30 could be long enough to attach directly to the control module/machine interface or to another harnass, an I/O board, a terminal strip, etc. The prior design requires a cable to extend from the cylinder to the control module.

The cylinder length sensor mounting/retaining assembly serves to securely retain a length sensor within a hydraulic cylinder while providing access to the sensor without requiring disassembly of the cylinder. The structure prevents the sensor seal from disengaging in the event that the sensor retention cap mounting bolts were to loosen or fail. Additionally, the use of an over-molded cordset does not require disassembly of the connector when removing the sensor from the cylinder.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A cylinder length sensor mounting and retaining assembly for a hydraulic cylinder, the assembly comprising:

a casing attachable to a blind end of the hydraulic cylinder;

a sensor retention cap affixable adjacent the blind end of the hydraulic cylinder to close a sensor receiving channel, the sensor retention cap securing a cylinder length sensor in the channel, wherein the sensor retention cap engages the casing and the cylinder length sensor on a common axial plane;

a first channel extending through the casing and oriented substantially in alignment with the sensor receiving channel, the first channel having open ends such that the sensor retention cap can be affixed or removed with the casing attached to the hydraulic cylinder;

a second channel extending through the casing and intersecting the first channel; and a locking pin extendable through the second channel, wherein the second channel is positioned relative to the sensor retention cap such that with the locking pin extending through the second channel, the locking pin is disposed adjacent the sensor retention cap, wherein the sensor retention cap comprises a sensor retention cap cavity that is a recess formed in a sensor receiving channel side of the sensor retention cap, wherein the sensor retention cap includes a convex section that convexly extends toward the locking pin to define the sensor retention cap cavity on the sensor receiving channel side of the sensor retention cap.

2. An assembly according to claim 1, wherein the second channel is substantially perpendicular to the first channel.

3. An assembly according to claim 1, wherein the sensor retention cap is secured to the casing with a plurality of mounting bolts.

4. An assembly according to claim 1, wherein the second channel is defined by separate and aligned pin receiving sections, and wherein the first channel bisects the pin receiving sections.

5. An assembly according to claim 4, wherein with the locking pin extending through the second channel, the locking pin is positioned to block the first channel.

6. An assembly according to claim 5, wherein the locking pin is spaced from sensor retention cap by an amount that prevents the sensor retention cap from moving enough to leak.

7. An assembly according to claim 1, wherein the sensor retention cap cavity is shaped such that it is positively draining and allows moisture to exit freely from the cavity.

8. An assembly according to claim 1, further comprising an overmolded cordset through which a control module connector extends without requiring an electrical junction at the cylinder.

9. An assembly according to claim 1, wherein the locking pin is a pivot pin that is connectable to adjoining structure on which the hydraulic cylinder acts.

10. A cylinder length sensor mounting and retaining assembly for a hydraulic cylinder, the assembly comprising:

a casing attachable to a blind end of the hydraulic cylinder, the casing including a channel therethrough with first and second open ends;

a sensor retention cap affixable to the second open end of the casing through the first open end of the casing adjacent the blind end of the hydraulic cylinder, the sensor retention cap securing a cylinder length sensor in the channel, wherein the sensor retention cap engages the casing and the cylinder length sensor on a common axial plane; and a locking pin extendable through the casing and positioned adjacent the sensor retention cap, wherein the sensor retention cap includes a convex section that convexly extends toward the locking pin to define a sensor retention cap cavity on a sensor receiving channel side of the sensor retention cap, wherein the locking pin is positioned relative to the convex section of the sensor retention cap such that the locking pin blocks the sensor retention cap from linear displacement beyond an amount that would allow a sensor seal to disengage.

11. An assembly according to claim 10, wherein the sensor retention cap is secured to the casing with a plurality of mounting bolts.

12. An assembly according to claim 10, wherein the sensor retention cap cavity is shaped such that it is positively draining and allows moisture to exit freely from the cavity.

13. An assembly according to claim 10, further comprising an overmolded cordset through which a control module connector extends without requiring an electrical junction at the cylinder, wherein the cordset extends out of the casing through the sensor retention cap.

14. A method of mounting and retaining a cylinder length sensor in a hydraulic cylinder, the method comprising:

securing a casing to a blind end of the hydraulic cylinder; then affixing a sensor retention cap to the casing adjacent the blind end of the hydraulic cylinder, securing a cylinder length sensor in a sensor receiving channel with the sensor retention cap, the sensor retention cap engaging the casing and the cylinder length sensor on a common axial plane; and then positioning a locking pin through a channel in the casing such that the locking pin is disposed adjacent the sensor retention cap, wherein the affixing step is practiced by providing the sensor retention cap with a sensor retention cap cavity that is a recess formed in an inside facing side of the sensor retention cap, by providing the sensor retention cap with a convex section that convexly extends toward the locking pin to define the sensor retention cap cavity on a sensor receiving channel side of the sensor retention cap, and by positioning the sensor retention cap cavity at least partially over an end of the cylinder length sensor.

15. A method according to claim 14, wherein the positioning step is practiced by defining a first channel that extends through the casing and is oriented substantially in alignment with the sensor receiving channel, by defining a second channel extending through the casing and intersecting the first channel, and by extending the locking pin through the second channel positioned relative to the sensor retention cap such that with the locking pin extending through the second channel, the locking pin is disposed adjacent the sensor retention cap.

* * * * *